US008429792B2

(12) United States Patent
Genn et al.

(10) Patent No.: US 8,429,792 B2
(45) Date of Patent: Apr. 30, 2013

(54) SWITCH AND MOTOR ASSEMBLY

(75) Inventors: Stuart Lloyd Genn, Malmesbury (GB); James Dyson, Malmesbury (GB); Thomas Jenkins, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 872 days.

(21) Appl. No.: 12/376,766

(22) PCT Filed: Jul. 17, 2007

(86) PCT No.: PCT/GB2007/002682

§ 371 (c)(1),
(2), (4) Date: Sep. 14, 2009

(87) PCT Pub. No.: WO2008/017804

PCT Pub. Date: Feb. 14, 2008

(65) Prior Publication Data

US 2010/0186190 A1 Jul. 29, 2010

(30) Foreign Application Priority Data

Aug. 8, 2006 (GB) ..... 0615685.5

(51) Int. Cl.
*A47L 9/22* (2006.01)

(52) U.S. Cl.
USPC ..... 15/412

(58) Field of Classification Search ..... 15/412, 15/319, 334, 373, 390, 391, 361
See application file for complete search history.

(56) References Cited

U.S. PATENT DOCUMENTS

| | | | | |
|---|---|---|---|---|
| 4,245,370 | A * | 1/1981 | Baker | 15/319 |
| 4,637,092 | A | 1/1987 | Hayashi et al. | |
| 5,768,735 | A * | 6/1998 | Wiese et al. | 15/49.1 |
| 6,351,872 | B1 * | 3/2002 | McCormick | 15/334 |
| 2003/0051308 | A1 | 3/2003 | Morgan et al. | |
| 2003/0051309 | A1 * | 3/2003 | Morgan et al. | 15/373 |

FOREIGN PATENT DOCUMENTS

| | | |
|---|---|---|
| EP | 0 217 201 | 4/1987 |
| EP | 0 947 155 | 10/1999 |
| GB | 1035754 | 7/1966 |
| GB | 2 422 093 | 7/2006 |

OTHER PUBLICATIONS

GB Search Report dated Nov. 10, 2006, directed to counterpart GB Patent Application No. 0615685.5; 1 page.
International Preliminary Report on Patentability, mailed Aug. 8, 2008, directed to counterpart International Patent Application No. PCT/GB2007/002682; 6 pages.
International Search Report and Written Opinion, mailed Sep. 25, 2007, directed to counterpart International Patent Application No. PCT/GB2007/002682; 13 pages.

* cited by examiner

*Primary Examiner* — Robert Scruggs
(74) *Attorney, Agent, or Firm* — Morrison & Foerster LLP

(57) ABSTRACT

A cleaning appliance includes a motor arranged to drive a fan for generating suction air flow and a cleaner head having a drivable agitator with a dedicated motor. The agitator drive motor has a selectively-operable switch and a resettable circuit breaker arranged such that, when the switch is activated, the circuit breaker is reset. A button actuates the switch and simultaneously resets the circuit breaker. When there is a blockage so that the circuit breaker trips out the motor, the user can reset the circuit breaker and restart the agitator motor by the simple act of depressing one button, thereby obviating the need for a separate control.

12 Claims, 5 Drawing Sheets

SWITCH AND MOTOR ASSEMBLY

REFERENCE TO RELATED APPLICATIONS

This application is a national stage application under 35 USC 371 of International Application No. PCT/GB2007/002682, filed Jul. 17, 2007, which claims the priority of United Kingdom Application No. 0615685.5, filed Aug. 8, 2006, the contents of which prior applications are incorporated herein by reference.

FIELD OF THE INVENTION

This invention relates to a switch and motor assembly for a surface-treating appliance, such as a vacuum cleaner.

BACKGROUND OF THE INVENTION

The majority of vacuum cleaners are either of the 'upright' type or of the 'cylinder' type, called canister or barrel cleaners in some countries. An upright vacuum cleaner normally comprises a main body containing dirt and dust separating apparatus, a cleaner head rotatably mounted on the main body and having a dirty air inlet, and a motor and fan unit for drawing dirty air into the dirt and dust separating apparatus via the dirty air inlet so that dirt and dust can be separated from the airflow before the clean air is expelled to the atmosphere. The dirty-air inlet through which dirty air is sucked into the vacuum cleaner is directed downwardly so that it faces the floor to be cleaned. The dirt and dust separating apparatus can take the form of a filter bag or, as is known, can alternatively take the form of a cyclonic arrangement. The present invention is not concerned with the nature of the dirt and dust separating apparatus and is therefore applicable to vacuum cleaners utilising either arrangement.

An agitator in the form of, for example, a brush bar is supported in the dirty-air inlet so that it protrudes to a small extent from the inlet. The brush bar typically comprises an elongate cylindrical core from which bristles extend along its length in a radial direction. The brush bar may be driven by a dedicated motor, typically via a drive belt, so that the brush bar rotates within the inlet. Rotation of the brush bar causes the bristles to flick dirt and debris from the fibres of the carpet to be cleaned. The suction of air causes air to flow around the brush bar and underneath it to help lift the dirt and dust from the surface to be cleaned and then carry it from the dirty-air inlet to the dirt and dust separating apparatus. Use of the agitator when cleaning a carpeted surface provides a superior cleaning performance than if an agitator is not used.

A problem which may be encountered with surface-treating appliances employing an agitator is that the agitator motor must be protected from overheating and/or overloading under adverse operating conditions which may arise. Such a situation may occur, for example, in the event the rotary agitator becomes jammed through engagement with the fringe of a rug or other object that prevents or restricts rotation of the agitator.

SUMMARY OF THE INVENTION

The invention provides a switch and motor assembly for a surface-treating appliance comprising a motor for driving an agitator, a first switch arranged to energise selectively the agitator-drive motor, a resettable circuit breaker and a first actuator common to both to the first switch and the circuit breaker arranged such that, when a user employs the first actuator to activate the first switch, the actuator mechanically resets the circuit breaker.

The provision of a controller that automatically resets the circuit breaker when the user activates or re-activates the agitator motor switch greatly simplifies operation for the user. Previously, resetting the circuit breaker was effected by means of a separate controller, typically in the form of a user-operable button located on the appliance incorporating the motors. It has been found that, when the circuit breaker comes into operation, so that the agitator ceases to function, the user intuitively deactivates and reactivates the switch for the agitator drive motor in an attempt to restart the agitator drive motor. In doing so with the assembly of the invention, the user automatically resets the circuit breaker, thereby allowing the agitator motor to be re-energised. The actuator provides a direct mechanical link between the switch and circuit breaker.

Preferably, the actuator is in the form of a user-operable button that activates and deactivates the switch whilst moving the plunger associated with the circuit breaker.

A second motor having a dedicated switch may also be provided. The controller may be arranged to also control activation of the switch so that, when a user operates the switch so as to energise the second motor, the switch associated with the agitator motor automatically is activated. This feature prevents the user from forgetting to energise the agitator motor when the second motor is first energised. Thereafter, the agitator motor may be independently energised and de-energised by means of the first switch. The controller may be arranged to automatically de-activate the switch for the agitator motor when the user de-activates the switch for the second motor. This feature ensures that the agitator motor is de-energised automatically when the user de-energises the second motor.

The invention is particularly applicable to surface-treating appliances, such as vacuum cleaners. In such an application, the second motor may be the main vacuum motor that generates suction for the purpose of lifting dirt and dust from a floor surface.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
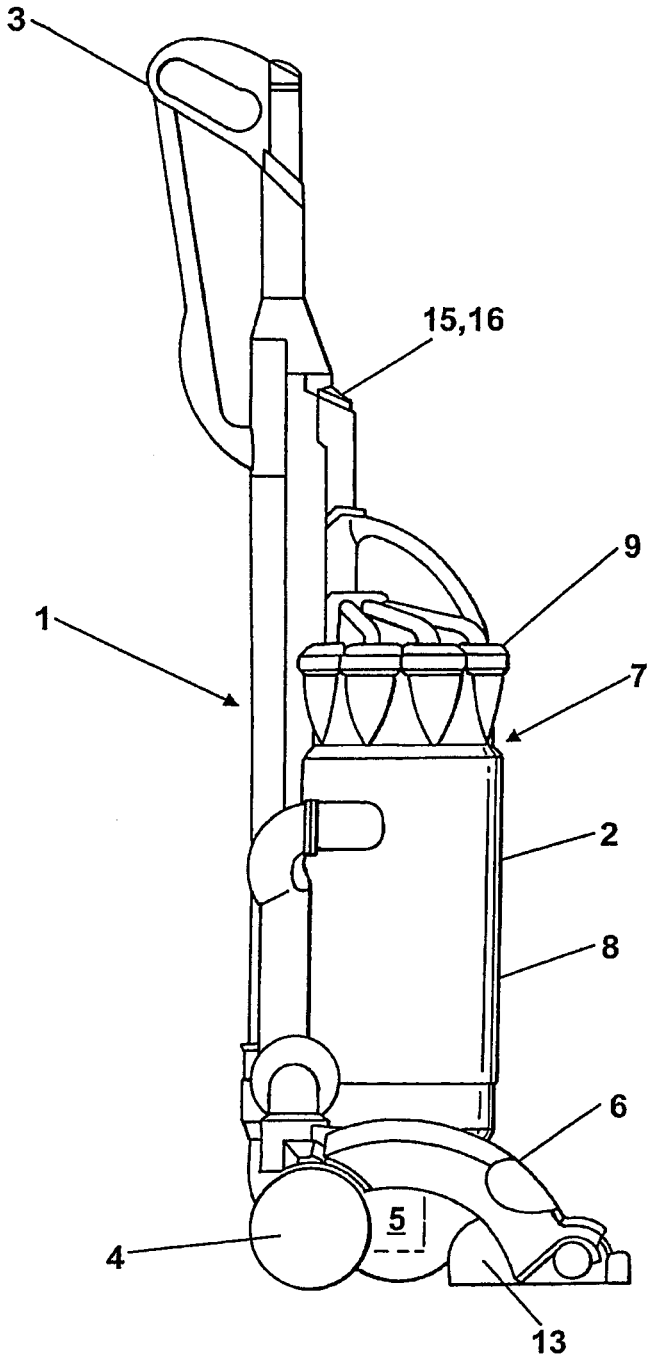
FIG. 1 is a side view of a surface treating appliance incorporating an assembly constructed in accordance with the invention.
Figure 2:
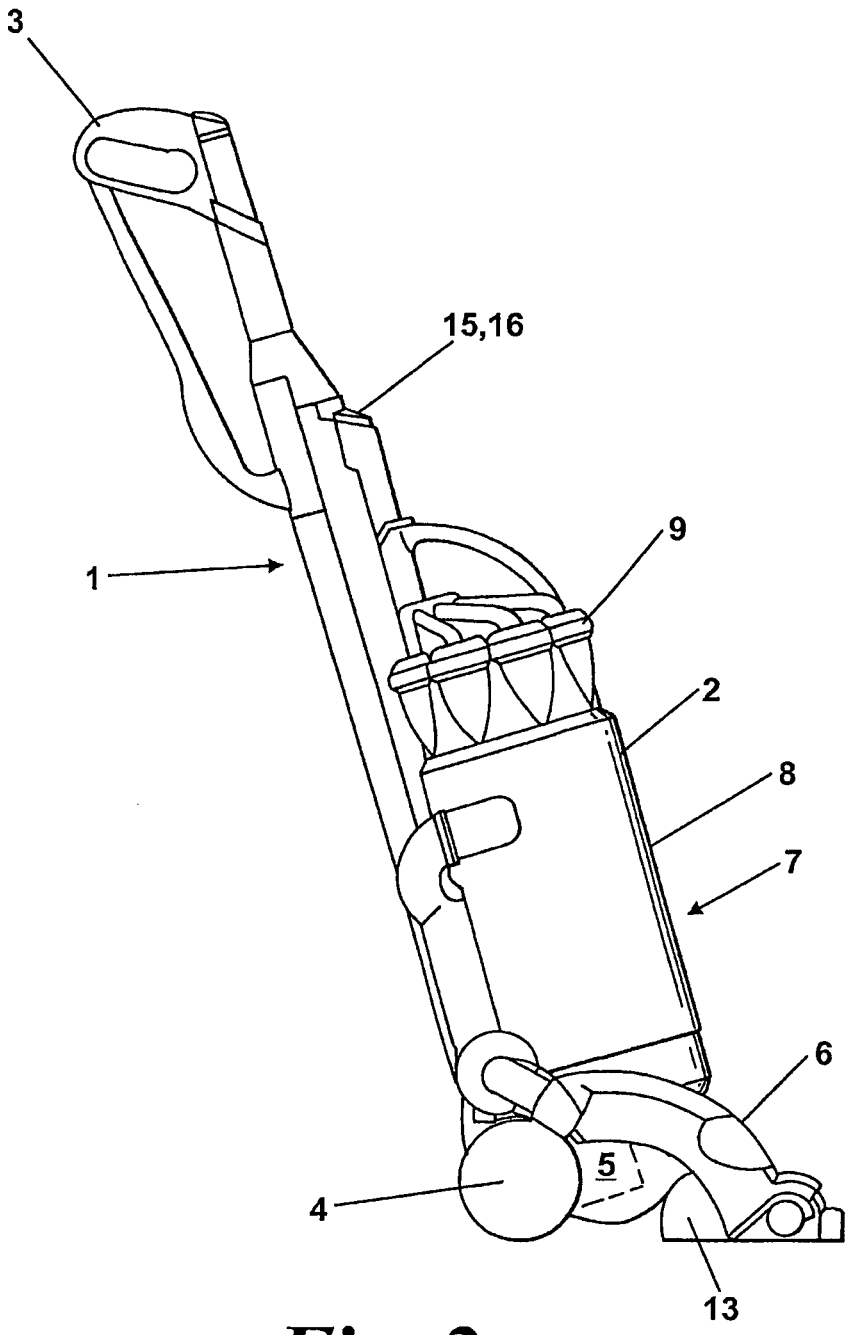
FIG. 2 is a side view of the appliance of FIG. 1 in a mode of use.

With reference to FIGS. 1 and 2, the surface treating appliance is shown in the form of a vacuum cleaner and is indicated generally by the reference numeral 1. The vacuum cleaner 1 comprises a main body 2, a user-operable handle 3 and a set 4 of wheels for rolling the cleaner along a floor surface. At a lower end of the main body 2 is located a motor casing, which houses a motor 5 arranged to drive a fan for generating suction in order to draw a fluid, such as air, into the cleaner 1. A cleaner head 6 is mounted in an articulated fashion at the lower end of the main body 2.

Figure 3:
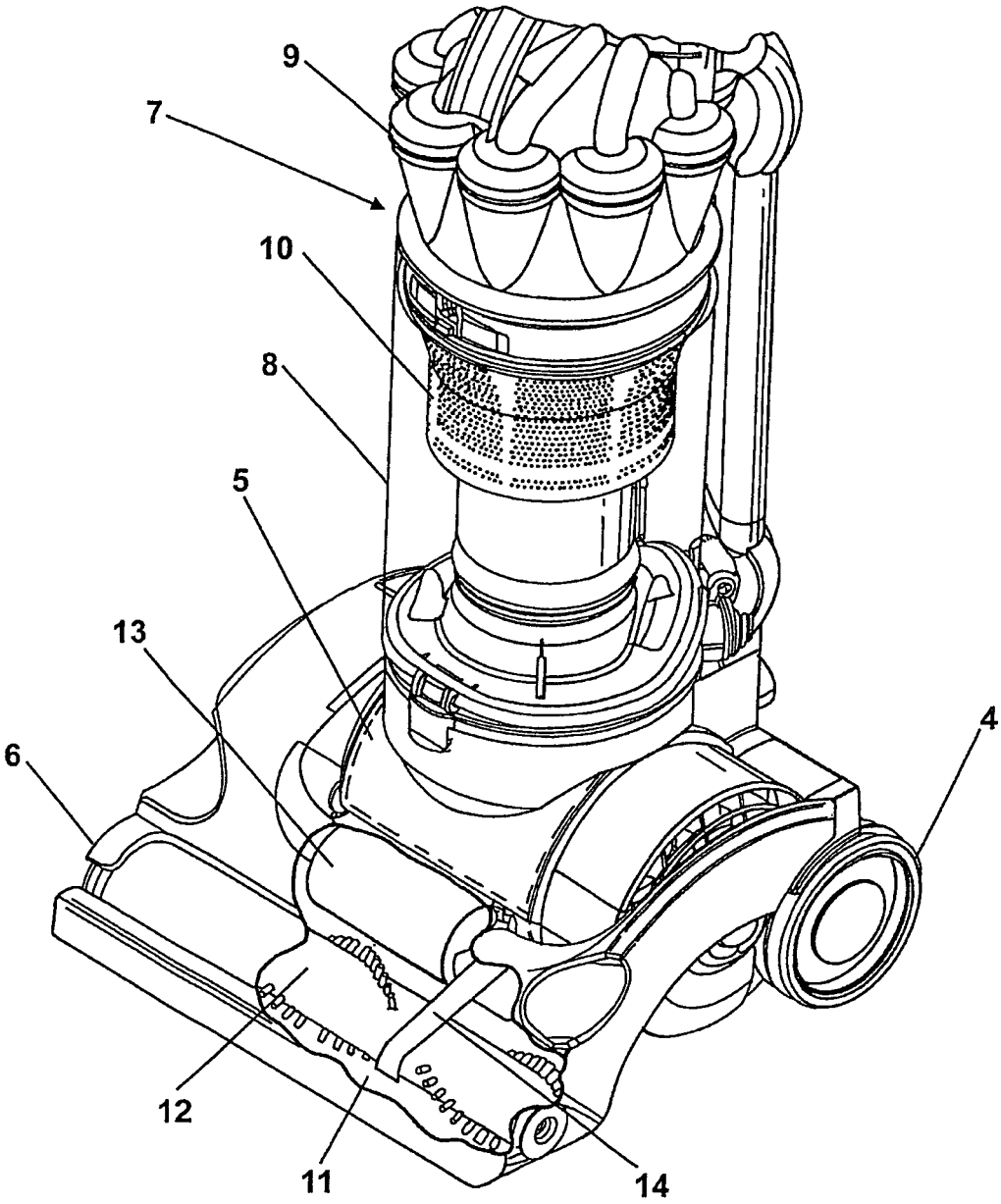
FIG. 3 is a perspective, partly cut-away view of the surface-treating head of the appliance of FIGS. 1 and 2.

The main body 2 houses separating apparatus 7 for separating dirt, dust and other debris from a dirty airflow drawn into the machine by the fan driven by the motor 5. In this embodiment, the separating apparatus 7 is cyclonic, in which the dirt and dust is spun from the airflow. The cyclonic separating apparatus 7 comprises two stages of cyclone separation arranged in series with one another. The first stage is a cylindrically-walled chamber 8 and the second stage comprises a set 9 of tapering, substantially frusto-conically shaped chambers arranged in parallel with one another. Airflow is directed tangentially into the upper part of the chamber 8. Larger debris and particles are removed cyclonically and collected in the chamber 8. The airflow then passes through a shroud (indicated by the reference numeral 10 in FIG. 3) to the set 9 of smaller frusto-conically shaped cyclonic chambers. Finer dust is separated by these chambers 9 and the separated dust is collected in a common collecting region. The second set 9 of separators can be upright, i.e. with their fluid inlets and outlets at the top and their dirt outlets at the bottom, or inverted, i.e. with their fluid inlets and outlets at the bottom and their dirt outlets at the top. The nature of the dust separating apparatus 7 is not material to the present invention.

The main body 2 also houses filters (not visible in these drawings) for trapping fine particles in the cleaned airflow. These filters remove any fine particles of dust which have not already been removed from the airflow by the separating apparatus. A first filter, called a pre-motor filter, is provided before the motor and fan. A second filter, called a post-motor filter, is provided after the motor and fan. Where the motor 5 for driving the suction fan has carbon brushes, the post-motor filter also serves to trap any carbon particles emitted by the brushes. Clean air is then expelled to the atmosphere.

The handle 3 extends upwardly from the rear part of the main body 2. When the cleaner 1 is in the position shown in FIG. 1, it can be used in a cylinder mode, in which case the handle 3 may be released and used as a hose and wand assembly. A changeover valve on the main body 2 automatically connects the dust separating apparatus 7 to the wand and hose assembly so that cleaner can be used in this cylinder mode for above the floor cleaning. Air is drawn into the cleaner through the end of the wand which can be released from the cleaner for appropriate manipulation.

When the cleaner 1 is to be used in conventional upright cleaning mode, the user employs the handle 3 to recline the main body 2, as is shown in FIG. 2. The cleaner head 6 serves to treat the floor surface in the upright cleaning mode, and is shown in more detail in FIG. 3. In this embodiment, it comprises a chamber 11 for supporting an agitator in the form of a brush bar 12. The lower, floor-facing side of the chamber 11 has an air inlet slot and the brush bar 12 is rotatably mounted in the chamber such that bristles on the brush bar can protrude through the inlet slot and can agitate the floor surface over which the cleaner head is made to pass. The brush bar 12 is rotatably driven by a dedicated agitator drive motor 13 positioned inside the cleaner head 6. A belt and pulley system, a belt 14 of which is visible in this drawing, connects the motor 13 to the brush bar 12 to provide drive.

Figure 4:
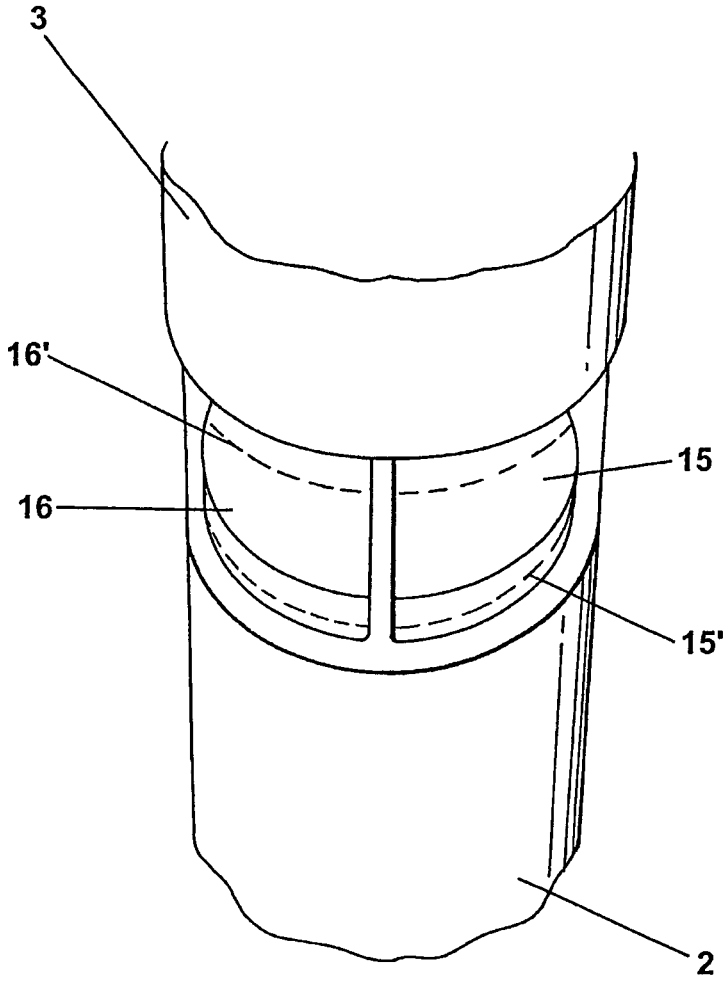
FIG. 4 is a front view of actuators forming part of the appliance of FIGS. 1 to 3.

A user can select energisation and de-energisation of both the main motor 5 and the brush bar motor 13 by means of switches, which are operable by the user by means of actuators in the form of depressible buttons, which are illustrated in FIG. 4. The button 15 is arranged to activate and deactivate the switch for energising the main motor 5. When the button 15 is pressed by the user, it latches in a lower position, as indicated by the broken line 15', to indicate its state to the user. The button 16 is employed to control the motor 13 arranged to drive the agitator 12. When this button is pressed, it also latches in a lower position, as indicated by the broken line 16', to indicate its state to the user. When the cleaner 1 is being used to clean carpets, the user can selectively energise the agitator motor 13, to operate the agitator 12. In use, the agitator 12 agitates the fibres of the carpet, thereby releasing dirt and dust from the fibres. When the cleaner 1 is being used to clean hard floors, or is being used in cylinder mode, the agitator can be switched off The buttons 15, 16 may have visual indicia on them to indicate their respective functions. The buttons 15, 16 are conveniently located adjacent each other in a position that is easily visible to the user—in this embodiment, they are located at the top of the main body 2 of the machine, adjacent the base of the handle 3.

Figure 5:
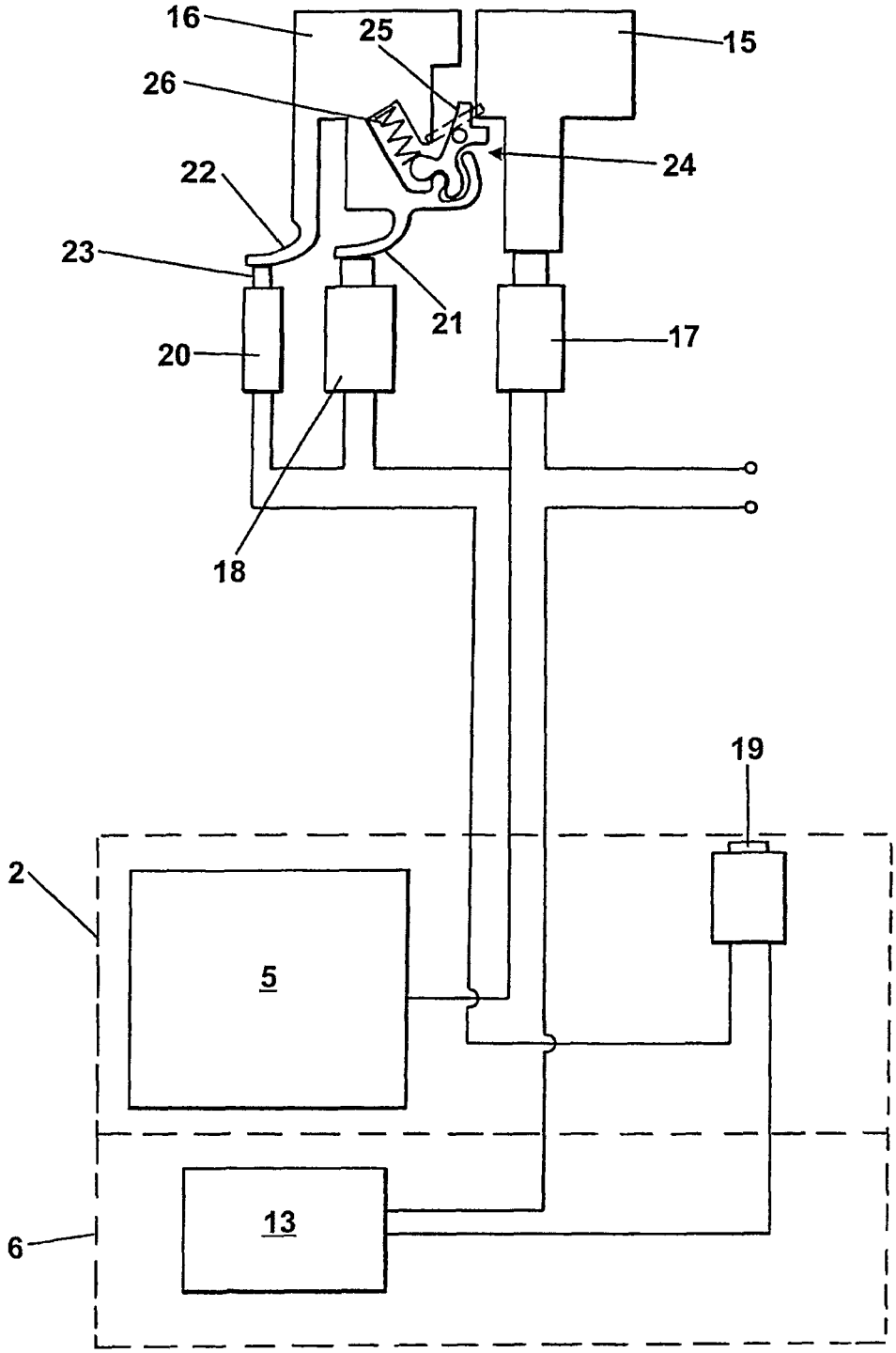
FIG. 5 is a schematic diagram of the switch and motor assembly forming part of the appliance of FIGS. 1 to 3.

The overall scheme of motors and switches in the appliance is shown in FIG. 5. Button 15 is arranged to actuate a switch 17 that controls energisation of the motor 5 in the main body 2. Similarly, button 16 is arranged to actuate a switch 18 that controls energisation of the agitator drive motor 13 in the cleaner head 6. The switch 18 is connected to the agitator drive motor 13 by means of a so-called tilt-switch 19, provided in the main body 2. The tilt switch 19 is arranged to detect when the main body 2 has been tilted backwards for upright cleaning, and to allow the agitator motor to be selectively energised when the cleaner is being used in upright mode. The tilt-switch 19 may be arranged to prevent the agitator motor 13 from being energised when the main body 2 is in its upright position, in order to prevent the agitator from being driven when the cleaner 1 is being used in cylinder mode.

A circuit breaker 20 for the agitator motor 13 is also provided. When the cleaner 1 is being used in an upright cleaning operation with the agitator 12 being driven by its motor 13, it is possible that the agitator may become jammed by objects left on the floor surface or by the fringe of a rug. The circuit breaker 20 ensures that the motor 13 does not overheat and burn itself out when such a jam occurs. When the agitator 12 becomes jammed, a higher than usual current is drawn by the agitator drive motor 13. When the current exceeds a predetermined value, a bimetallic element inside the switch 20 heats up and trips, thereby de-energising the agitator motor 13. The user can then safely remove the blockage. The portion of the cleaner head 6 adjacent the chamber 11 for the agitator may be transparent, so that the user can see whether there is a blockage preventing rotation of the brush bar 12.

The circuit breaker 20 needs to be re-set before the agitator 12 can be driven again by the motor 13. This is an important safety feature. In accordance with the invention, when the switch 18 controlling the agitator motor is activated, the circuit breaker 20 is re-set. This is effected by means of a controller, which, in this embodiment, is realised in the form of an actuator common to both the switch 18 and the circuit breaker 20, the actuator being the button 16.

When the button 16 is pressed by the user, a first flexible member 21 on the underside of the button activates the switch 18. Simultaneously, the second flexible member 22, also located on the underside of the button 16, is urged against a plunger 23 that resets the circuit breaker 20. The members 21 and 22 are arranged so that the second member 22 depresses the plunger 23 before the member 21 throws the switch 18. The members 21 and 22 are flexible to allow for manufacturing tolerances in the components making up this assembly.

Thus, the user can reset the circuit breaker 20 by the act of re-activating the agitator drive motor 13. Previously, the actuator for resetting the circuit breaker was located separately on the cleaner 1 and it was found that the user had difficulty locating it or understanding its purpose. After the user has cleared the blockage, it is intuitive for the user to re-activate the switch 18 for the agitator drive motor 13 by depressing the button 16. In doing so, the user unconsciously also resets the circuit breaker 20, permitting re-energisation of the motor 13. The invention obviates the need for a separate resetting assembly for the circuit breaker.

Each time the user activates the switch 18, the action of depressing the button 16 causes resetting of the circuit breaker 20, even if the circuit breaker 20 has not tripped. There is no disadvantage to this arrangement, but it does ensure that the circuit breaker can be automatically reset after tripping has occurred.

As a further benefit, the buttons 15 and 16 are connected by means of a linkage 24 arranged so that, when the button 15 is depressed in order to energise the main motor 5, the button 16 is simultaneously urged against the switch 18, thereby automatically switching on the agitator motor 13. The user sometimes forgets to employ the agitator 12 during a cleaning operation; this arrangement ensures that the agitator is automatically brought into operation when the main motor 5 is switched on. In this embodiment, the linkage 24 is mechanical and is in the form of a pivotable arm 25, resiliently biased by means of a helical spring 26. When the button 15 is depressed, a corner of the button engages with one end portion of the arm 25, urging it downwards. Thus, the button 16 is compelled to move downwardly also, whereupon it latches into its lowered position.

When the main motor 5 has been switched on, and both buttons 15, 16 have latched into their lowered positions, the button 16 may be independently actuated so that the agitator motor 13 may be brought in and out of operation as required by the user. The arm 25 of the linkage mechanism 24 pivots against the force of the spring 26 to permit movement of the button 16 into the raised and lowered positions. The arm 25 itself cannot influence movement of the button 15.

When the user finishes a cleaning operation, he presses button 15 in order to deactivate the switch 17 and de-energise the main motor 5. As the button 15 returns to its raised position, the linkage 24 acts to urge the button 16 to its original position so that the switch 18 is deactivated. Thus, when the main motor 5 is de-energised, the agitator motor 13 is also automatically is de-energised. This feature ensures that the agitator motor 13 is not accidentally left on by the user after a cleaning operation.

Although the invention has just been described with reference to an upright cleaner, it is also applicable to cylinder cleaners, which have a surface-treating head located at the end of the hose and wand assembly. The cleaner head may also be provided in the form of a floor tool, which may be fitted to the end of a hose and wand assembly of a vacuum cleaner of either type.

Of course, further variations may be made without departing from the scope of the invention. For example, although the controller communicating with the agitator motor switch and the circuit breaker has been realised mechanically as a user-operable button in the illustrated embodiment, this connection may alternatively be electronic, or may even be realised in software form. Similarly, the linkage between the actuators 15, 16 for the motor switches could also be arranged electronically or by software control.

Although the switches are shown as being physically electrically connected to their respective motors, wireless signals may be employed to activate and de-activate the motors.

A circuit breaker may also be provided for the main motor 5, to prevent overheating of the motor. The actuator for controlling energisation of the main motor switch may also be arranged automatically to actuate this second circuit breaker in order to reset it.

While the illustrated embodiment shows a vacuum cleaner in which ducts carry airflow, it will be appreciated that the invention can be applied to vacuum cleaners which carry other fluids, such as water and detergents.

The invention claimed is:

1. A switch and motor assembly for a surface-treating appliance comprising a motor for driving an agitator, a first switch configured to energize selectively the agitator-drive motor, a resettable circuit breaker and a controller comprising a first actuator common to both the first switch and the circuit breaker, the controller mechanically controlling the first switch and the circuit breaker such that, when the first switch is activated to energize the agitator-drive motor, the circuit breaker is reset automatically.

2. The assembly as claimed in claim 1, further comprising a second motor and a second switch for selectively energizing the second motor.

3. The assembly as claimed in claim 2, in which the controller further comprises a second actuator operable to actuate the second switch and to communicate with the first switch by a mechanical linkage such that, when the second switch is activated, the first switch is also activated.

4. The assembly as claimed in claim 3, in which the first and second actuators are configured such that, while the second switch remains activated, the first switch may be independently activated and deactivated.

5. The assembly as claimed in claim 3 or 4, in which the actuators are configured such that, when the second switch is deactivated, the first switch is also deactivated.

6. The assembly as claimed in claim 1, 2, 3 or 4, in which the circuit breaker is arranged to interrupt power to the agitator drive motor if the current drawn by the agitator drive motor exceeds a predetermined value.

7. The assembly as claimed in claim 1, 2, 3 or 4, in which the circuit breaker includes a bimetallic element arranged such that its deformation by thermal effect trips the circuit breaker.

8. A surface-treating appliance comprising an agitator and a switch and motor assembly comprising a motor for driving an agitator, a first switch configured to energize selectively the agitator-drive motor, a resettable circuit breaker and a controller comprising a first actuator common to both the first switch and the circuit breaker, the controller mechanically controlling the first switch and the circuit breaker such that, when the first switch is activated to energize the agitator-drive motor, the circuit breaker is reset automatically.

9. The surface-treating appliance as claimed in claim 8, further comprising a second motor and a second switch for selectively energizing the second motor, the second motor being configured to drive a fan for generating suction air flow.

10. The surface-treating appliance as claimed in claim 8 or 9, in which each actuator comprises a user-operable button.

11. The surface-treating appliance as claimed in claim 8 or 9, in which the agitator comprises a rotatable brush bar.

12. The surface-treating appliance as claimed in claim 8 or 9 comprising a vacuum cleaner.

* * * * *